US008971695B2

(12) United States Patent
Tyburk et al.

(10) Patent No.: US 8,971,695 B2
(45) Date of Patent: Mar. 3, 2015

(54) PORTABLE HEATER

(75) Inventors: Neil R. Tyburk, Canton, OH (US); Patrick M. Nolan, Canton, OH (US)

(73) Assignee: Suarez Corporation Industries, North Canton, OH (US)

( * ) Notice: Subject to any disclaimer, the term of this patent is extended or adjusted under 35 U.S.C. 154(b) by 1036 days.

(21) Appl. No.: 12/755,746

(22) Filed: Apr. 7, 2010

(65) Prior Publication Data

US 2010/0254686 A1 Oct. 7, 2010

Related U.S. Application Data

(60) Provisional application No. 61/167,339, filed on Apr. 7, 2009.

(51) Int. Cl.

| | |
|---|---|
| ***F24H 3/00*** | (2006.01) |
| ***F23Q 7/00*** | (2006.01) |
| ***F24F 3/04*** | (2006.01) |
| ***F24H 3/04*** | (2006.01) |

(Continued)

(52) U.S. Cl.

CPC ..... *F24H 3/0417* (2013.01); *F24H 9/0063* (2013.01); *F24H 9/0073* (2013.01); *F24H 9/02* (2013.01)

USPC ..... 392/373; 392/375; 392/503; 392/356; 392/304; 392/407; 219/365; 219/342; 219/368; 219/370; 219/408; 165/123; 165/179; 165/183; 165/156; 165/172

(58) Field of Classification Search

CPC ... F24H 3/0417; F24H 9/0063; F24H 9/0073; F24H 9/02

USPC ..... 392/373, 375, 503, 304, 306, 311, 313, 392/320, 331, 335–336, 355–361, 407, 424, 392/480–490; 165/123, 179, 183–185, 126, 165/141, 148, 156–160, 172–178; 219/365, 219/342, 368, 370, 377, 406–412, 483, 504, 219/386, 339, 341, 354, 359, 366, 367, 369, 219/373, 378, 382

See application file for complete search history.

(56) References Cited

U.S. PATENT DOCUMENTS

| | | | |
|---|---|---|---|
| 1,006,767 | A | 10/1911 | Mauger |
| 1,534,571 | A | 4/1925 | Conning |
| 2,379,705 | A | 7/1945 | Graves |

(Continued)

FOREIGN PATENT DOCUMENTS

| | | | |
|---|---|---|---|
| GB | 2283810 | A | 5/1995 |
| JP | 53-13242 | A | 2/1978 |

(Continued)

OTHER PUBLICATIONS

International Search Report and Written Opinion issued Nov. 18, 2010 in corresponding PCT Application PCT/US2010/030202.

(Continued)

*Primary Examiner* — Dana Ross
*Assistant Examiner* — Ket D Dang
(74) *Attorney, Agent, or Firm* — Pearne & Gordon LLP

(57) ABSTRACT

A heater is provided with a heater core having a source of thermal energy in a heat exchange relationship with a heat exchanger. A fan moves air through the heater core from an air inlet to an air outlet. The heater core is thermally insulated by an air jacket from an exterior case.

26 Claims, 6 Drawing Sheets

(51) Int. Cl.
*F24H 9/00* (2006.01)
*F24H 9/02* (2006.01)

(56) References Cited

U.S. PATENT DOCUMENTS

| | | | | |
|---|---|---|---|---|
| 2,527,013 | A | 10/1950 | Kjelgaard | |
| 2,919,338 | A | 12/1959 | Covault et al. | |
| 3,575,582 | A | 4/1971 | Covault | |
| 3,777,728 | A | 12/1973 | Reiche | |
| 4,052,593 | A | 10/1977 | Ebert | |
| 4,164,642 | A | 8/1979 | Ebert | |
| 4,197,447 | A | 4/1980 | Jones | |
| 4,307,284 | A | 12/1981 | Perron | |
| 4,309,594 | A | 1/1982 | Jones | |
| 4,680,448 | A * | 7/1987 | Fester | 392/356 |
| 4,835,367 | A | 5/1989 | Hoffman | |
| 4,900,898 | A | 2/1990 | Kling | |
| 5,013,893 | A | 5/1991 | Goessler et al. | |
| 5,157,239 | A | 10/1992 | Kanaya et al. | |
| 5,568,586 | A | 10/1996 | Junkel | |
| 5,954,980 | A | 9/1999 | Westerberg et al. | |
| 5,990,460 | A | 11/1999 | Petty et al. | |
| 6,041,994 | A | 3/2000 | Hwang et al. | |
| 6,297,481 | B1 | 10/2001 | Gordon | |
| 6,327,427 | B1 | 12/2001 | Burkett | |
| 6,745,758 | B1 | 6/2004 | Minidis | |
| 7,046,918 | B1 * | 5/2006 | Burkett et al. | 392/375 |
| 8,247,742 | B2 * | 8/2012 | Searle et al. | 219/408 |
| 2002/0059782 | A1 | 5/2002 | Kadota et al. | |
| 2011/0100971 | A1 * | 5/2011 | Searle et al. | 219/210 |

FOREIGN PATENT DOCUMENTS

| | | | | |
|---|---|---|---|---|
| JP | 57-21954 | U | 2/1982 | |
| JP | 2-282655 | A | 11/1990 | |
| JP | 05-018611 | A | 1/1993 | |
| JP | 7-42535 | U | 8/1995 | |
| JP | 62-293029 | A | 12/1997 | |
| JP | 10-122664 | A | 5/1998 | |
| JP | 10-253163 | A | 9/1998 | |
| JP | 2002-81748 | A | 3/2002 | |
| JP | 2005-024213 | A | 1/2005 | |
| JP | 2007-309628 | A | 11/2007 | |
| KR | 20-0215912 | Y1 | 3/2001 | |
| KR | 20-2009-0002515 | U | 3/2009 | |
| WO | 92/10709 | A1 | 6/1992 | |
| WO | WO 2008057321 | A2 * | 5/2008 | F24H 3/04 |
| WO | WO 2008140700 | A1 * | 11/2008 | F24H 3/04 |

OTHER PUBLICATIONS

International Search Report and Written Opinion issued Jan. 12, 2012 in PCT Application Serial PCT/US2011/038717.

Notice of Reasons for Rejection issued in corresponding Japanese Patent Application No. 2012-504811 on Jul. 10, 2013.

Office action issued in corresponding Canadian Patent Application No. 2,758,075 on Jul. 17, 2013.

Office action issued in corresponding Chinese Patent Application No. 201080009938.X on Sep. 16, 2013.

* cited by examiner

PORTABLE HEATER

CROSS-REFERENCE TO RELATED APPLICATIONS

This application claims the benefit of U.S. Provisional Application No. 61/167,339, filed Apr. 7, 2009, the entire disclosure of which is hereby incorporated herein by reference.

FIELD OF THE INVENTION

The present invention relates generally to a heater, and more specifically, to a portable or space heater.

BACKGROUND OF THE INVENTION

With the diminishing supply of fossil fuels and their associated spiraling costs, more homes and businesses are using space heaters as their primary or secondary heating source. It is beneficial for such space heaters to be easy to service and thermally efficient.

BRIEF SUMMARY OF THE INVENTION

In accordance with one aspect of the present invention, a heater is provided comprising an exterior case comprising an air inlet and an air outlet and a heater core within the exterior case and being in communication with the air inlet and the air outlet. A fan communicates with the air inlet and the air outlet for moving air through the heater core. The heater core comprises a source of thermal energy and a heat exchanger. The heat exchanger comprises an inner duct and an outer duct, both cylindrical having a circular cross-section in the illustrated embodiment. The inner duct is disposed adjacent and surrounding the source of thermal energy and the outer duct surrounds the inner duct to define an intermediate chamber between the inner and outer ducts. The inner and outer ducts of the heat exchanger are each oriented along a longitudinal axis extending between walls of the exterior case wherein the air inlet and air outlet are disposed.

In accordance with another aspect of the present invention, a heater comprises an exterior case comprising an air inlet and an air outlet and a heater core within the exterior case and being in communication with the air inlet and the air outlet. A fan communicates with the air inlet and the air outlet for moving air through the heater core.

The heater core comprises a source of thermal energy and a heat exchanger. The heat exchanger is disposed within the heater core and extends along a longitudinal axis extending between walls of the exterior case wherein the air inlet and air outlet are disposed. The heat exchanger comprises an inner duct surrounding the source of thermal energy and an outer duct surrounding the inner duct. An air pathway defines a path of air movement progressing from the air inlet, through the heat exchanger, and out the air outlet, wherein the air pathway progresses through the heater in a direction substantially parallel to the longitudinal axis.

In accordance with another aspect of the present invention, a heater comprises an exterior case comprising an air inlet and an air outlet and a heater core within the exterior case and being in communication with the air inlet and the air outlet. A dividing wall separates the heater core into a first portion adjacent the air inlet and a second portion adjacent the air outlet. The dividing wall inhibits fluid communication between the air inlet and air outlet, and the dividing wall further comprises an opening extending therethrough. A fan communicates with the air inlet and the air outlet for moving air through the heater core. The heater core comprises a source of thermal energy and a heat exchanger. The heat exchanger is disposed within the heater core and comprises an inner duct surrounding the at least one source of thermal energy and an outer duct surrounding the inner duct. The heat exchanger is in fluid communication with the opening, such that air moving through the heater core from the first portion to the second portion is forced to proceed through the heat exchanger prior to being discharged through the opening and thereafter through the air outlet.

DESCRIPTION OF EXAMPLE EMBODIMENTS

Figure 1:
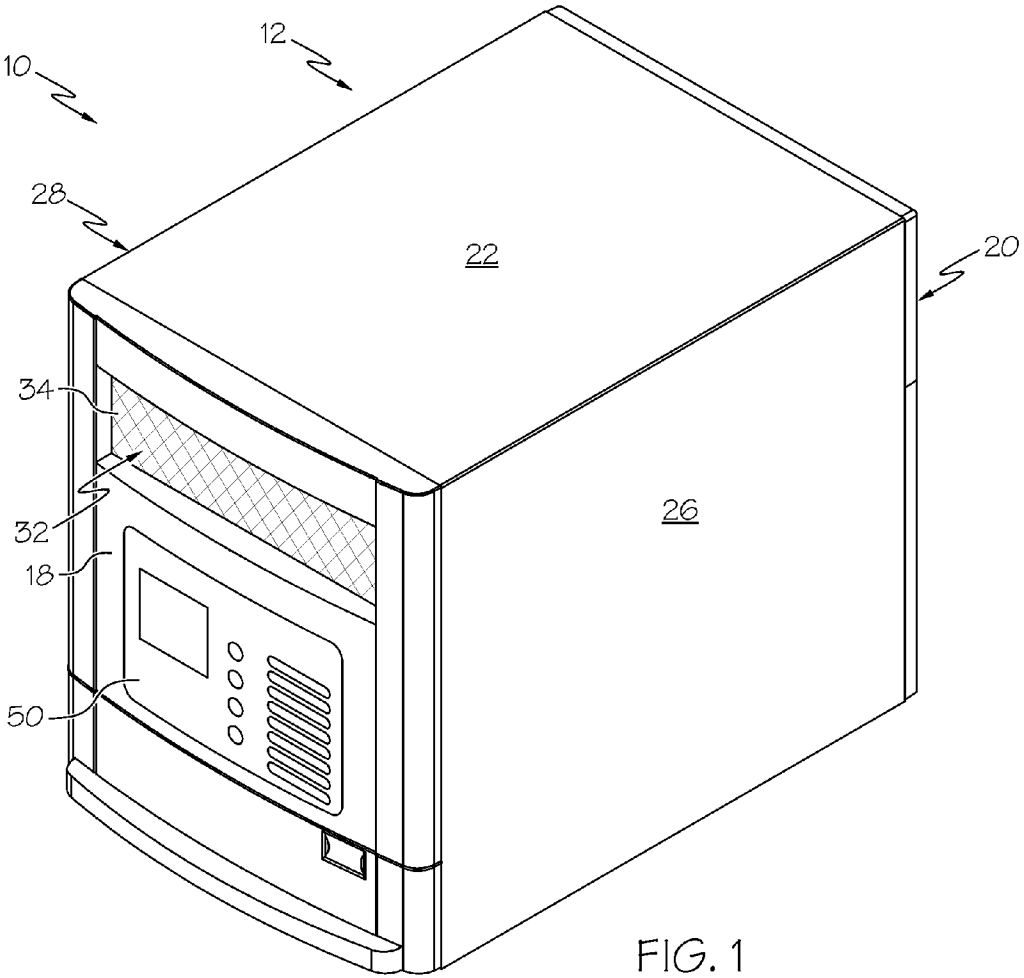
FIG. 1 is a perspective view of an example heater.
Figure 2:
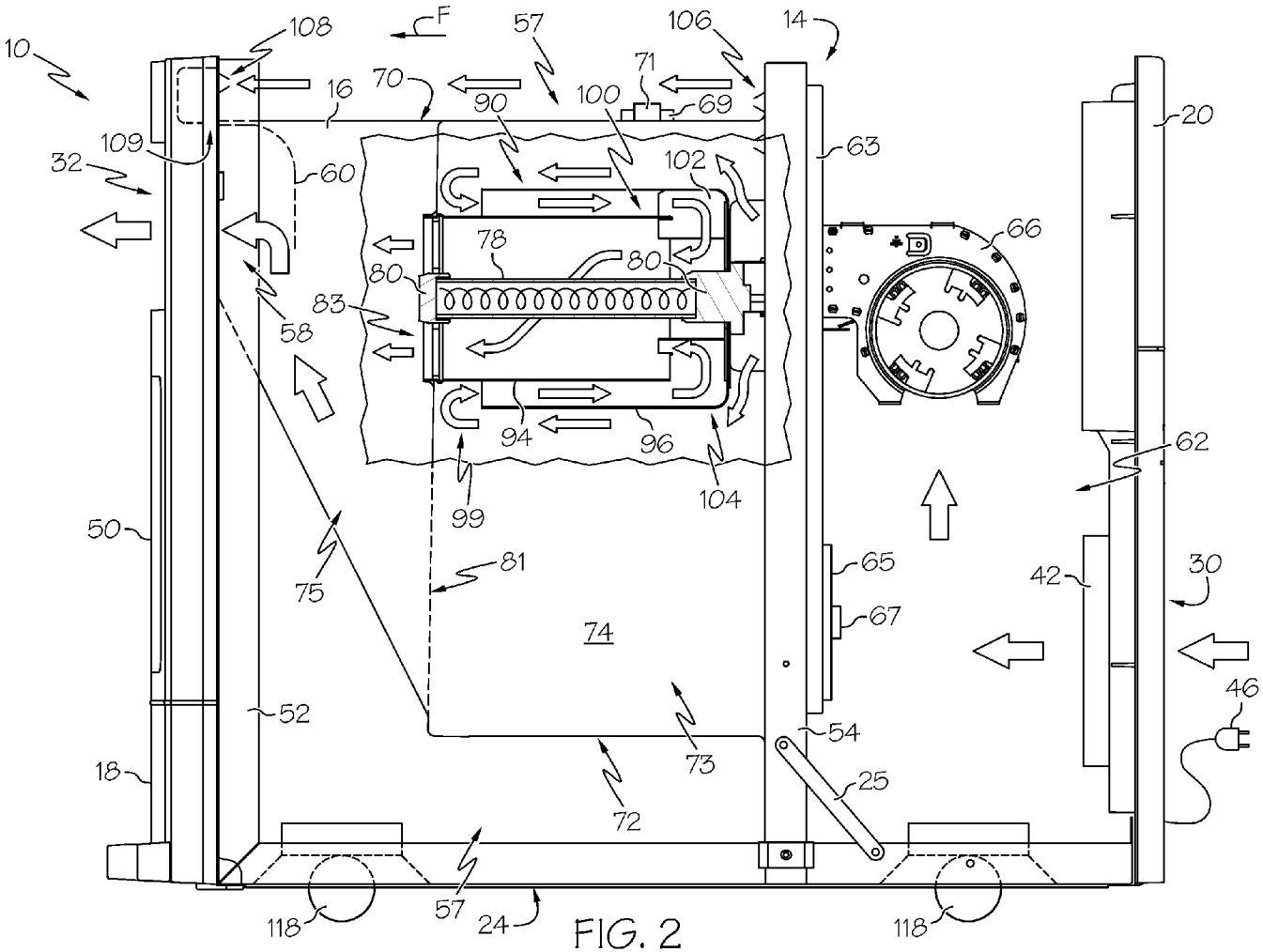
FIG. 2 is a side, partial detail view of the heater of FIG. 1.

Turning to FIGS. 1 and 2, reference numeral 10 refers to an example portable heater, which may be referred to herein as a space heater. Heater 10 comprises an exterior case 12, a heater core support 14 mounted inside exterior case 12 and a heater core 16 supported by heater core support 14. The heater core 16 can include various structure for heating air passing therethrough, such as sources of energy, heat exchangers, etc. Where possible, the various structural elements can be coupled together by a minimal number of fasteners and joints, such as by a minimal number of screws or the like, projections received in slots, or other removable or even non-removable locking structure, for improved serviceability. Further, the heater 10 can include various other elements, such as described in U.S. Pats. Nos. 6,327,427 and 7,046,918, the contents of which are incorporated herein by reference in their entirety.

Exterior case 12 can be a generally box-like structure including a front wall 18, a rear wall 20, a top wall 22, a bottom wall 24 and side walls 26, 28. An air inlet 30 is provided in rear wall 20 and an air outlet 32 is provided in front wall 18. As will be described herein, air can flow through the heater 10 generally along the direction of arrow F. Air inlet 30 and air outlet 32 can be covered with protective grilles, respectively. In addition or alternatively, a filter 42 can be positioned over air inlet 30 and/or air outlet 32. For example, the filter 42 may be attached to rear wall 20 with various fasteners, such as hook-and-loop style fasteners or the like. Filter 42 may be of conventional construction, for example fiberglass or equivalent material as is commonly used in furnace filters. In one example, the filter 42 can be a POLYTRON filter or similar. Some or all of the walls, such as any of the front wall 18, top wall 22 and bottom 24 wall may be integrally formed as a wrapper to which side walls 26, 28 are formed with or joined with sheet metal screws, rivets, and/or by other conventional methods of construction such as welding, brazing and the use of fasteners, such a projection received in a slot, or combinations of methods as is known in the art. In one example, the top wall 22 and both side walls 26, 28 can be formed from a single sheet of material, which can be bent to define the top wall 22 and side walls 26, 28. In addition or alternatively, the heater 10 can be supported by one or more stationary or movable feet coupled to the bottom wall 24. In one example, the feet can be rotatable wheels 118, such as casters. The bottom wall 24 can include recesses, through holes, or the like to allow the casters to be at least partially recessed into the bottom wall 24 such that the heater 10 can be positioned relatively closer to a floor or other supporting surface. In one example, the rotatable wheels 118 can be coupled to the bottom wall 24 by mechanical fasteners, adhesives, welding, or even by a twist-lock arrangement, which can be similar to or different than the heat exchanger 90 mounting described herein.

Exterior case 12 generally encloses heater core support 14. Heater core support 14 can comprise a front mounting panel 52 and a rear mounting panel 54. In addition or alternatively, front mounting panel 52 may be spaced a distance from front wall 18, or may be directly adjacent thereto. For example, the front wall 18 can include a decorative plastic panel coupled to the mounting panel 52. The front mounting panel 52 can be secured to at least one of the top wall 22, bottom wall 24 and side walls 26, 28. In one example, front mounting panel 52 can be formed together with the bottom wall 24 (or even the top wall 22), such as being made out of the same sheet of metal, and may be bent relative to the bottom wall 24 so as to be generally perpendicular to the bottom wall 24 to facilitate manufacturing. Alternatively, front mounting panel 52 can be the same as the front wall 18. An aperture 58 is provided in front mounting panel 52 above which can be mounted a deflector shield 60 for directing air towards air outlet 32. The deflector shield can be visible from the exterior of the unit, and can be colored or otherwise configured to be visually appealing.

The rear mounting panel 54 can be secured to at least one of top wall 22, bottom wall 24 and side walls 26, 28 and can be spaced a distance from rear wall 20. In one example, the rear mounting panel 54 can be coupled to the bottom wall 24 by a mechanical fastener, such as a screw, rivet, or the like, and/or can also utilize a projection received in a slot for improved structural rigidity. In addition or alternatively, the rear mounting panel 54 can include at least one, such as a pair, of a reinforcing braces 25 coupled to the bottom wall 24. In another example, rear mounting panel 54 can be formed together with the bottom wall 24 (or even the top wall 22), such as being made out of the same sheet of metal, and may be bent relative to the bottom wall 24 so as to be generally perpendicular to the bottom wall 24 to facilitate manufacturing. In one example, all of the bottom wall 24, front mounting panel 52, and rear mounting panel 54 can be formed from a single sheet of metal.

The space between rear mounting panel 54 and rear wall 20 of exterior case 12 can form an intake chamber 62. In addition or alternatively, an intake manifold 63, in communication with a fan 66, can be provided within the intake chamber 62. The intake manifold 63 can be removably or non-removably coupled to the rear mounting panel 54 in various manners, such as with sheet metal screws and/or by other conventional methods of construction such as welding, brazing and/or the use of fasteners, such a projection received in a slot, or combinations of methods as is known in the art. In one example, the intake manifold 63 can hang onto the rear mounting panel 54 by one or more projection-in-slot fasteners, and can also be coupled to the rear mounting panel 54 by screws. The intake manifold 63 can include at least one aperture 64 extending therethrough for providing fluid communication between the fan 66 and the heater core 16. For example, the fan 66 can be mounted to the intake manifold 63 about the aperture 64 for drawing air into heater 10 though air inlet 30 in rear wall 20 and forcing air out through the heater core 16 (via aperture 58) and out the air outlet 32. Alternatively, the fan may be located proximate the air inlet 30, to draw air in through that opening and direct it through the intake chamber 62 and aperture 64, and into the heater core 16. Various fans operated at various speeds can be used, including axial, centrifugal, cross-flow, etc.

A conventional power cord 46 can extend from rear wall 20 for connecting the electrical components within exterior case 12 to a conventional 110 volt A.C. line. If desired, heater 10 may have a power cord strain relief or the like installed in the hole through which power cord 46 passes. In addition or alternatively, a variable thermostatic control 50 can be mounted to either or both of the front wall 18 (shown) or even to the rear wall 20 (not shown). The variable thermostatic control 50 can include analog and/or digital structure for adjusting a desired temperature or operational range (i.e., relatively hotter or cooler) and/or fan speed (i.e., relatively faster or slower), and may include various knobs, buttons, or other selector structure. In addition or alternatively, the thermostatic control 50 can include various circuitry, sensors, such as various temperature sensors, humidity sensor(s), etc., and/or timer(s). Similarly, the variable thermostatic control 50 can include indicia or other indicator structure to provide a visual and/or audible display of the desired settings/selections. Input/output structure, which may be located at a convenient location (e.g., on the front or sides) may be electrically coupled but physically located apart from control structure (e.g., circuitry, sensors, etc.) that may be located within the unit. Structure can be provided for a visual and/or audible display of service information, such as warnings, filter change notifications, energy source 78 change notifications, etc. Thermostatic control 50 communicates with the operative components of the heater 10, such as the thermal energy source(s) and/or fan(s), to control operation thereof. An on-off switch (not shown) may be provided on front wall 18 or rear wall 20, if desired. An automatic-mode or manual-mode switch (not shown) may also be provided on front wall 18 or rear wall 20, if desired. A switch (not shown) may also be provided to operate the fan without the heating elements, so as to provide only air circulation.

In an embodiment of heater 10, one or more (such as a pair) of temperature sensors, which may also function as limit switches, can be provided about the heater core 16. A first temperature switch 67 can be located on or in heater core 16 to sense the air temperature inside the heater core 16. In one example, the first temperature switch is disposed close to the rear mounting panel 54 (or even the front mounting panel 52) adjacent where air enters (or exits) heater core 16, and acts as a fan control switch. In one example, the first temperature switch 67 can be mounted on a circuit board 65 or the like. When the temperature in heater core 16 rises above a predetermined temperature detected by the first temperature switch 67, such as 110 degrees F., fan 66 is switched on. Delayed starting of fan 66 until after the thermal energy sources are energized can be preferred such that cold air is not forced through air outlet 32. The first temperature switch 67 can act in reverse at the end of a heating cycle when heater 10 is shut off. In this mode, fan 66 continues to operate until the temperature drops below a predetermined temperature, such as 110 degrees F., improving the efficiency of heater 10 by extracting residual heat. A second temperature switch 69 can be located to sense the air temperature inside the heater core 16 at a different location than the first switch 67 and can function as a safety switch. The second temperature switch 69 can be located towards the top of the heater core 16 and can be retained by a bracket 71. When the temperature in heater core 16 rises above a predetermined temperature detected by the second temperature switch 69, such as 225 degrees F., the thermal energy sources can be shut down as a safety feature while said first temperature switch 67 keeps fan 66 running until the temperature in heater core 16 falls below a predetermined temperature, such as 110 degrees F. It will be apparent that the temperatures at which the temperature switches 67, 69 operate are arbitrary and a manner of design choice. Other switches may be used that are triggered at different temperature levels, times, etc.

Heater core 16 can be supported (e.g., by the front mounting panel 52 and the rear mounting panel 54) at a distance below top wall 22 and above bottom wall 24 of exterior case 12 and a distance from side walls 26, 28. This spacing of heater core 16 from exterior case 12 provides an air jacket 57 that extends at least partially about the heater core 16. In one example, the air jacket 57 can surround the heater core 16. Air jacket 57 can insulate the exterior case 12 to inhibit, such as prevent, overheating. In addition or alternatively, some or all of the interior surface(s) of the case 12 can include an insulating material. For example, the interior surfaces of the top wall 22 and side walls 26, 28 can all include insulating material. In addition or alternatively, the intake chamber and/or intake manifold 63 may form a portion of the air jacket 57, and/or can provide similarly insulating functionality. As such, it is possible for heater 10 to be safely operated with the exterior case 12 remaining generally cool to the touch, and/or with exterior case 12 fitted into a wood cabinet or the like. In one example, the air jacket 57 can be in fluid communication with the air inlet 30 via at least one opening 106 in the rear panel 54, and the air outlet 32 via at least one opening 108 in the front panel 52, to provide a cooling airflow through the air jacket 57. The intake manifold 63 can be arranged in covering and fluid communication with the opening(s) 106 such that positive airflow from the fan 66 is caused to flow into and through the air jacket 57 during operation of the heater 10. The airflow exiting the air jacket 57 via opening(s) 108 can proceed through at least one aperture 109. In one example, the aperture 109 can be a gap, such as a ⅛" clearance (or other dimension), located at the interface between the front wall 18 and the front mounting panel 52 and in flow communication with the air outlet 32. The aperture 109 can be formed (e.g., molded or otherwise manufactured) into either or both of the front wall 18 and front mounting panel 52. Thus, airflow exiting the opening(s) 108 can proceed through the aperture 109 to allow the air from the air jacket 57 to join and mix with the heated air exiting the heater core 16 through air outlet 32.

Heater core 16 generally comprises a top wall 70, a bottom wall 72 and side walls 74, 76 and is mounted upon front mounting panel 52 and rear mounting panel 54, which can define the end walls of the heater core. The heater core 16 can be mounted to the front and/or rear panels 52, 54 in various manners, including sheet metal screws, rivets, and/or by other conventional methods of construction such as welding, brazing and the use of fasteners, such a projection received in a slot, or combinations of methods as is known in the art. For example, the heater core 16 can be removably or non-removably coupled to the front and rear mounting panels 52, 54 in various manners, including fasteners, welding, adhesives, etc. In addition or alternatively, portions of the heater core 16 and/or front and rear mounting panels 52, 54 can include matching projections-in-slots to facilitate coupling thereof.

The heater core 16 can have various geometries to guide the airflow therethrough. For example, as shown, a first portion 73 of the heater core 16 located relatively closer to the rear wall 20 can have side walls 74, 76 of a generally uniform vertical dimension extending between the top 22 and bottom 24 walls, while a second portion 75 of the heater core 16 located relatively closer to the front wall 18 can have side walls 74, 76 with a changing vertical dimension extending in a direction between the top 22 and bottom 24 walls. For example, as shown, the second portion 75 can have a generally tapered geometry that gradually reduces the cross-sectional flow area defined by the side walls 74, 76 as the side walls 74, 76 approach the front wall 18 to thereby direct the air flow towards the outlet 32, and/or increase the exit velocity thereof by reducing the cross-sectional flow area. In addition or alternatively, the side walls 74, 76 of the first and second portions 73, 75 can have a generally uniform horizontal dimension extending in a direction between the side walls 26, 28 of the exterior case 12, or even have a changing horizontal dimension extending in a direction between the side walls 26, 28 of the exterior case 12 that tapers inwards.

Additionally, the heater core 16 can include a dividing wall 81 disposed between the first and second portions 73, 75. As will be further described, the dividing wall 81 can inhibit, such as prevent, fluid communication between the first and second portions 73, 75. The dividing wall 81 can include various sealing structures to facilitate dividing the first and second portions 73, 75.

The heater core 16 includes at least one thermal energy source 78, such as an infrared emitter, mounted between side walls 74, 76. In heater 10 shown in the drawings, mountings for three thermal energy sources 78 are provided with the sources 78 being mounted horizontally in a direction that extends generally between the front and rear walls 18, 20. In addition or alternatively, horizontal mounting of energy sources 78 is preferred as this arrangement improves serviceability of the heater 10 as will be further described.

Various example energy sources 78, such as radiant energy sources, can be utilized. For example, each thermal energy source 78 can comprise a high resistance wire wrapped in a helical configuration. The helically configured element is suspended within a quartz tube. The tube is capped with ceramic end pieces or caps 80. The tube may be vacuum sealed and may contain an inert gas. The quartz tube may be clear, semi-translucent or translucent. In a preferred embodiment, the thermal energy source 78 is linear and has a clear quartz tube. In one example embodiment, each of three energy sources 78 is 500 watts, where each source 78 draws about 4 amps. Thus, the total energy usage for operating the heater 10 is about 1500 watts so as to be operable on a standard household 110V A.C. outlet. Still, the thermal energy source 78 can have various geometries, such as curved, polygonal, random, etc.

Figure 3:
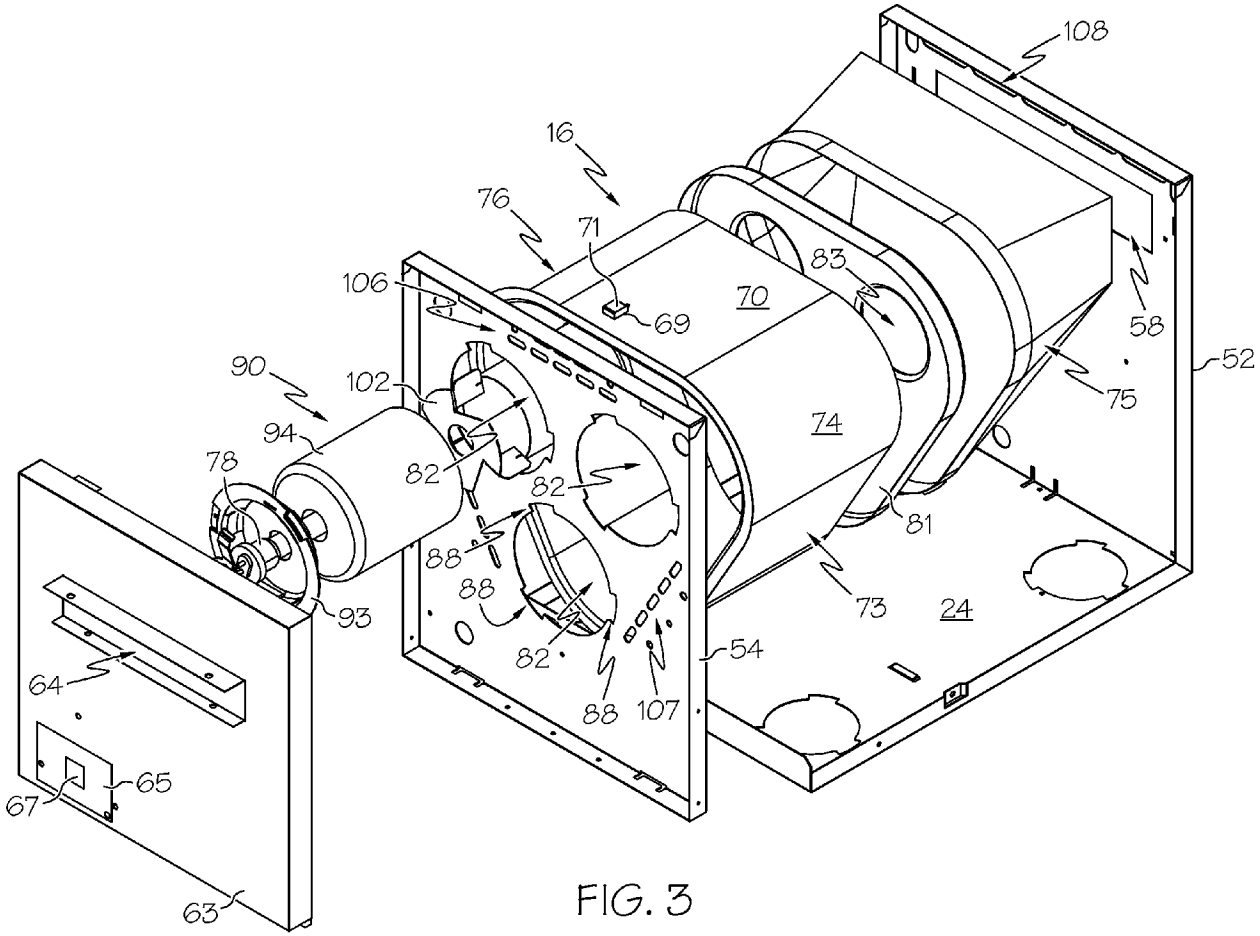
FIG. 3 is an exploded, perspective view of the heater of FIG. 1.
Figure 4:
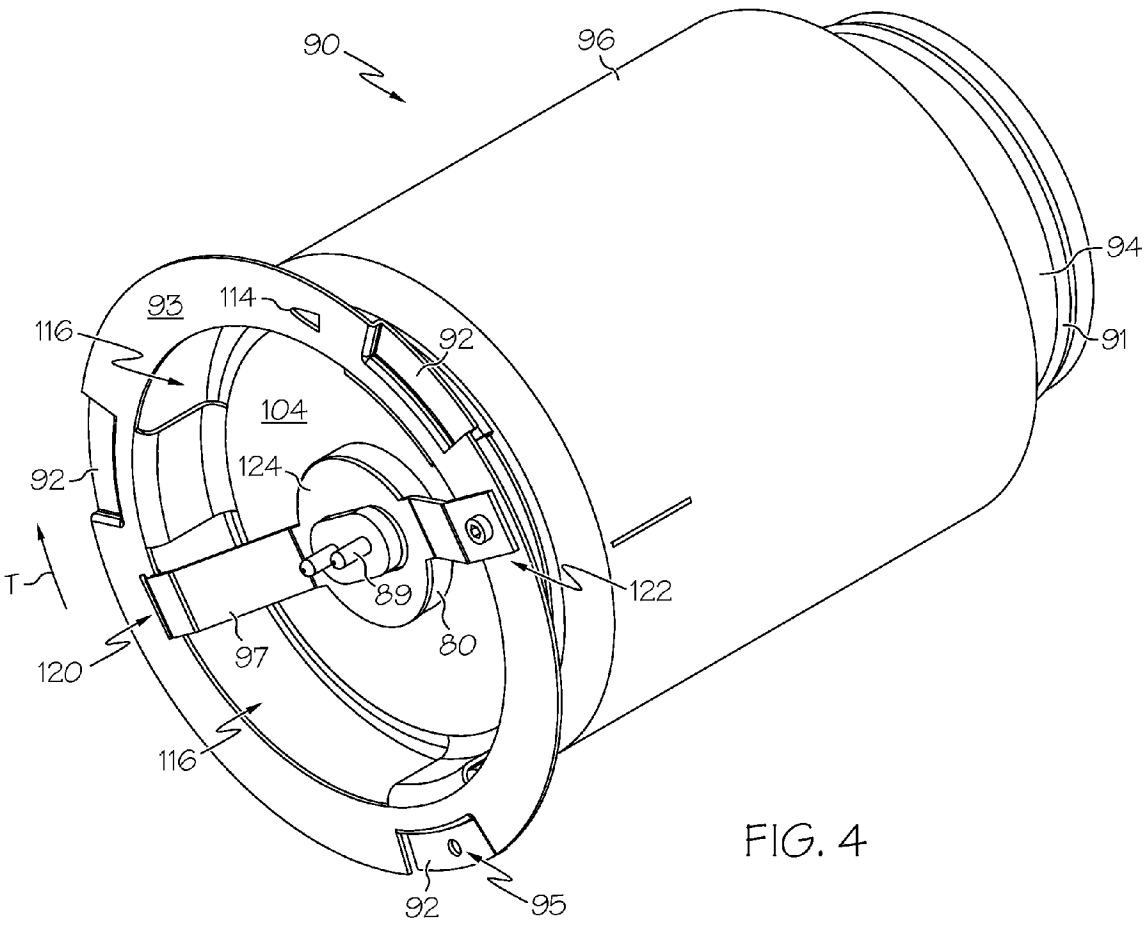
FIG. 4 is front perspective view of an example heat exchanger.
Figure 5:
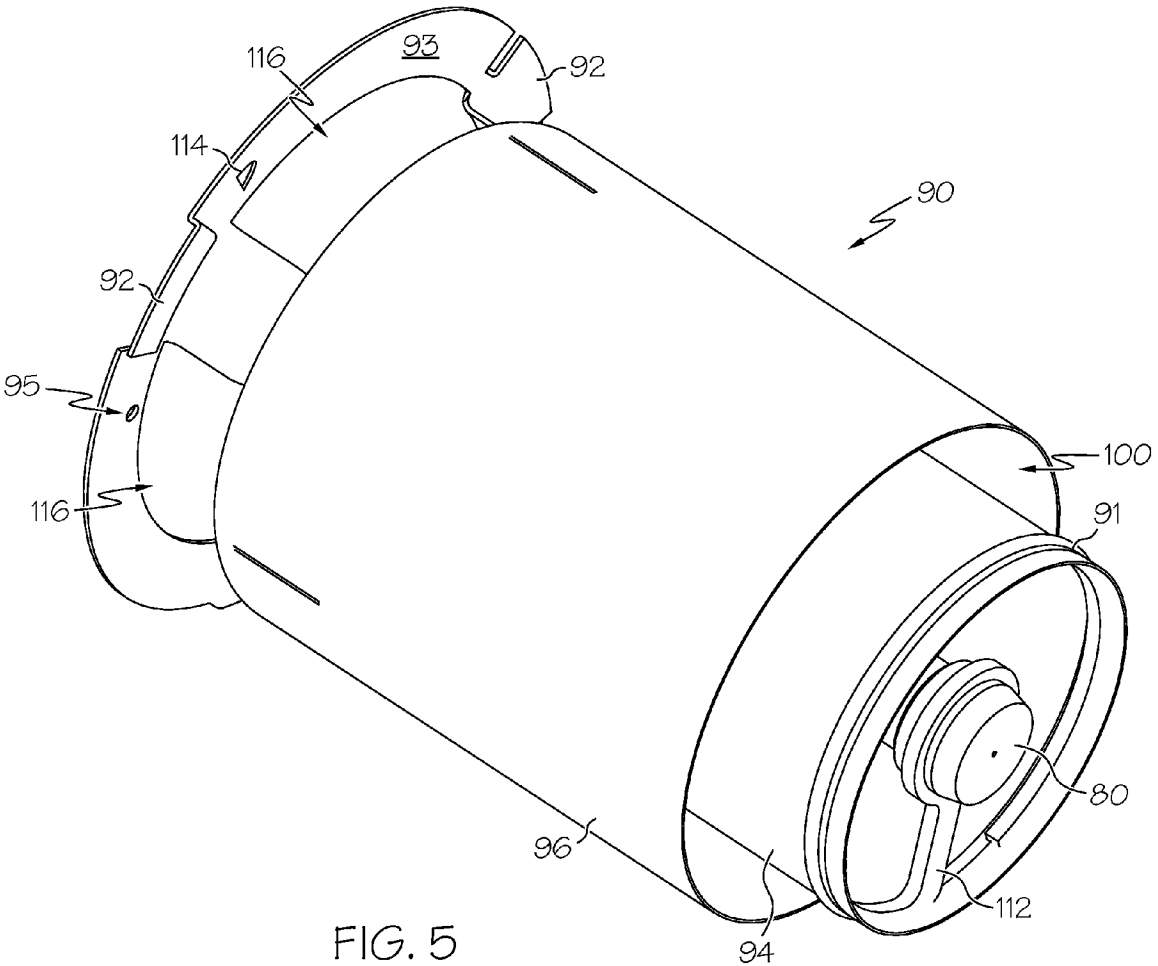
FIG. 5 is similar to FIG. 4, but shows a rear perspective view.

As shown in FIGS. 3-5, each energy source 78 can be provided within a heat exchanger. For example, a heat exchanger 90 is preferably in the form of a sheet of metal, such as copper or aluminum that may or may not be pretreated, and fashioned into a cylindrical geometry mounted around each of thermal energy source 78. Each heat exchanger 90 can be received in a hole 82 in the rear mounting panel 54, and can be configured variously, such as a tube-in-tube arrangement, as will be described. In one example, the heat exchanger 90 can include an inner cylinder 94 and an outer cylinder 96. The inner cylinder 94 can be arranged adjacent to, such as to face and/or surround, the associated thermal energy source 78, and the outer cylinder 96 can be arranged adjacent to, such as to face and/or surround, the inner cylinder 94. The inner cylinder 94 can have a relatively smaller cross-sectional area compared to the outer cylinder 96 so as to define an intermediate chamber 100 defined in the annular space therebetween. For example, the inner and outer cylinders 94, 96 can have a generally circular cross-sectional geometry, and the diameter of the inner cylinder 94 can be relatively smaller than the diameter of the outer cylinder 96. The inner cylinder 94 can have two generally open ends, such that air can flow therethrough, while the outer cylinder 96 can include at least one closed end 104, such that air flowing within the outer cylinder 96 is redirected. For example, as shown in FIG. 2, such an arrangement of the heat exchanger 90 can create a serpentine, circuitous "S"-shaped path for the airflow when viewed in cross-section.

In addition or alternatively, the inner cylinder 94 can be arranged generally concentric with the outer cylinder 96, though other relative arrangements are also contemplated. In addition or alternatively, the outer cylinder 96 may extend only partially along the length of the inner cylinder 94, so as to create a gap 99 therebetween. In addition or alternatively, the inner and outer cylinders 94, 96 can be coupled together in various manners, such as with sheet metal screws and/or by other conventional methods of construction such as welding, brazing and the use of fasteners, such a projection received in a slot, or combinations of methods as known in the art. In addition or alternatively, each heat exchanger 90 can include a mounting plate 93 coupled to the closed end 104, and spaced a distance from the closed end 104 to define one or more air passages 116. Thus, when the mounting plate 93 is coupled to the rear mounting panel 54, air passing through holes 82 in the rear mounting panel 54 can flow around the heat exchanger 90, via the air passages 116, and into the first portion 73 of the heater core 16. In addition or alternatively, air from the fan 66 can also pass into the first portion 73 of the heater core 16 through other holes 107 in the rear mounting panel 54. For example, the intake manifold 63 can be arranged in a covering relationship and in fluid communication with each of the holes 82 and holes 107, such that positive airflow from the fan 66 is caused to flow into the first portion 73 of the heater core 16 via all of the passages 116 and holes 107.

Each energy source 78 can be retained within a respective heat exchanger 90 by a bracket 97 or the like. In addition or alternatively, the other end of the energy source 78 can be retained by having a cap 80 thereof coupled to supporting structure 112, or even to one end of the outer cylinder 96. Either or both of the caps 80 can be adapted to retain the thermal energy source 78 mounted through hole 82 in various manners, such as via a snap-lock arrangement or the like. Thus, each cap 80 and source 78 can be designed to have a unique socket structure to facilitate replacement of a source 78 by a repair technician or even by the end-user. Electrically conductive wires can pass through the hole 82, or may be provided to either of the end caps 80, for energizing energy source 78. The electrically conductive wires can be pig-tailed at one end only, such as at the end adjacent the first portion 73 of the heater core 16 (i.e., more towards the rear wall 20) to further facilitate the replacement of a source 78 by a repair technician or even by the end-user. For example, as shown in FIG. 4, one of the end caps 80 can have an electrical plug 89 adapted to fit into electrical socket structure to facilitate decoupling each source 78 for replacement.

The bracket 97 can provide easy and quick serviceability of the energy source 78. In one example, the bracket 97 can be coupled to the heat exchanger 90 by having one end 120 fit into a slot of the mounting plate 93 while the other end 122 receives a mechanical fastener or the like. As shown in FIG. 4, the bracket 97 can also include a retaining plate 124 adapted to positively couple the energy source 78 to the heat exchanger 90. For assembly, the energy source 78 can be inserted into a hole in the closed end 104 of the heat exchanger 90. The one end 120 of the bracket 97 can be fit into the slot of the mounting plate 93. In one example, the one end 120 can have a bent or curved profile to permit the bracket 97 to be coupled to the mounting plate 93 in a pivoting, cantilever fashion. The bracket 97 can be pressed down until the retaining plate 124 presses upon the cap 80 of the energy source 78 such that the cap 80 is retained between the closed end 104 and the retaining plate 124. A portion of the end cap 80 with the electrical plug 89 can extend through a hole in the retaining plate 124 to be coupled to the electrical socket structure. The bracket 97 can then be retained in place by removably coupling the other end 122 to the mounting plate 93 by a mechanical fastener (e.g., screw, bolt, nut, etc.) or the like. In one example, a single mechanical fastener can be used. Disassembly can be performed in reverse. During disassembly, the bracket 97 can be at least partially removable from the heat exchanger 90 to permit replacement of the energy source 78. Upon loosening or removal of the fastener, the end 122 can be separated from the heat exchanger 90. In other examples, the end 120 of the bracket 97 can remain pivotally coupled to the mounting plate 93, or can be completely removed therefrom. With such structure, individual energy sources 78 can be quickly and easily replaced with little disassembly and few fasteners, such as by only removing the intake manifold 63 and one bracket 97, while the associated heat exchanger 90 need not be removed.

Mounting tabs 92 are provided on one end of heat exchanger 90 for attachment of said heat exchanger 90 in one of the corresponding holes 82 provided in rear mounting panel 54. Three generally similar holes 82 are provided in the rear panel 54 to each receive a separate one of the three heat exchangers 90, though various numbers of heat exchangers are contemplated. Each hole 82 can include one or more recesses 88 corresponding generally to the number of mounting tabs 92 provided to each heat exchanger 90. In the shown example, each heat exchanger 90 has three generally evenly spaced mounting tabs 92 and each hole 82 has three corresponding recesses 88. Each mounting tab 92 can be offset a distance from the mounting plate 93 of the heat exchanger 90. Each mounting tab 92 can have one end coupled to the mounting plate 93, and have the other end be free or detached from the mounting plate 93.

In one example, to couple a heat exchanger 90 to the rear panel 54, the heat exchanger 90 is inserted into the hole 82 with each mounting tab 92 being inserted into an associated recess 88. Next, the heat exchanger 90 can be rotated along the direction of arrow T, in a twist-lock arrangement, such that a portion of the rear panel 54 is captured in the offset space between each mounting tab 92 (i.e., via the free end) and the mounting plate 93. The bracket 97 can be utilized as a handle to facilitate the twisting. In addition or alternatively, each heat exchanger 90 can include various structure for positive retention within the rear panel 54. In one example, the mounting plate 93 of each heat exchanger 90 can include one or more holes 95 for further coupling the heat exchanger 90 to the rear panel 54 by a mechanical fastener (i.e., screw, rivet, or other fastener). In another example, mounting plate 93 can include an anti-rotation stop 114, such as a projection or the like, to inhibit rotation for removal of the heat exchanger 90 unless the stop 114 is depressed. Thus, the energy source 78 can be coupled to the heat exchanger 90 (i.e., via the bracket 97) such that the heat exchanger 90 can be removed as a modular unit from the heater 10 to facilitate easy replacement of the energy source 78, as well as easy manufacturing.

The length of the heat exchanger 90 can be generally shorter than the spacing between the front and rear mounting panels 52, 54 of heater core 16 so that there is a gap between a free end of heat exchanger 90 and the front mounting panel 52. In one example, the length of the heat exchanger 90 is generally at least as long as the length of the first portion 73 such that the heat exchanger 90 extends at least partially into the second portion 75 through the dividing wall 81. In one example, the inner cylinder 94 can extend at least partially into the second portion 75 through the dividing wall 81. In addition or alternatively, divider panels (not shown) can be provided for partitioning the inside of heater core 16 such that each heat exchanger 90 is in a separate compartment.

In addition or alternatively, the heat exchanger can further include a spacing coupler 102 extending between and coupling the inner cylinder 94 to the outer cylinder 96. For example, as shown in FIGS. 2-3, the spacing coupler 102 can be disposed generally within the outer cylinder 96 in a close-fitting arrangement, such as a frictional or interference fit. Another portion of the spacing coupler 102 can be coupled to an end of the relatively smaller diameter inner cylinder 94 to thereby provide a supporting structure extending between and coupling the inner cylinder 94 to the outer cylinder 96. In addition or alternatively, an open portion of the spacing coupler 102 can provide additional support for the energy source 78. In addition or alternatively, the spacing coupler 102 can be adapted to direct the airflow through the heat exchanger 90, such as to impart a swirling motion to the air passing through the heat exchanger 90. For example, as shown, the spacing coupler 102 can include a plurality of fins to direct the airflow. Some or all of the fins can also be coupled to an end of the relatively smaller diameter inner cylinder 94.

When heat exchanger 90 is formed of copper material, the copper can be pretreated at temperature and for a time sufficient to soften the copper material and to partially blacken the surface of the copper material. In an example embodiment, heat exchanger 90 can be formed from sheet copper having a thickness of 0.0216 inch and an oxygen content of 0.028% by weight. Heat exchanger 90 can be heated in an oven under ambient conditions for several hours at a temperature from about 850 degrees F. to about 900 degrees F. Any loose blackened material is removed by dry brushing inner cylinder 94 and outer cylinder 96 of heat exchanger 90. Good results have been obtained when heat exchanger 90 is heated for two hours at a temperature between about 850 degrees F. and 875 degrees F., after which heat exchanger 90 is dry brushed and then further heated for one hour at 425 degrees F. It is believed that equally good results would be obtained when heat exchanger 90 is heated for three hours at 875 degrees F. and then dry brushed to remove any loose particles. Removal of loose particles prevents them from being swept out air outlet 32 when heater 10 is first operated. Pretreatment of the copper can improve the heat efficiency of heater 10 by increasing the absorptivity and emissivity of heat exchanger 90 and roughening the walls of the inner and/or outer cylinders 94, 96 for more turbulent air flow. Optionally, the aforementioned copper composition and heat treatment may be applied to only the inner cylinder 94. Still, some or all of the copper material may not be pretreated.

When heat exchanger 90 is formed of aluminum material, the aluminum can be pretreated by anodizing. During the anodizing process, a clear film of aluminum oxide is laid down on the aluminum's surface. For use in heater 10, inner cylinder 94 of heat exchanger 90 is electrolytically colored a dark color to improve the material's radiant-heat properties, i.e., absorptivity and emissivity. It will be understood that outer cylinder 96 may also be electrolytically colored. Still, either or both of the cylinders 94, 96 (or even additional elements) can be formed from various other materials, such as various metals (e.g., steel), ceramics, etc. that may or may not be pretreated.

Figure 6:
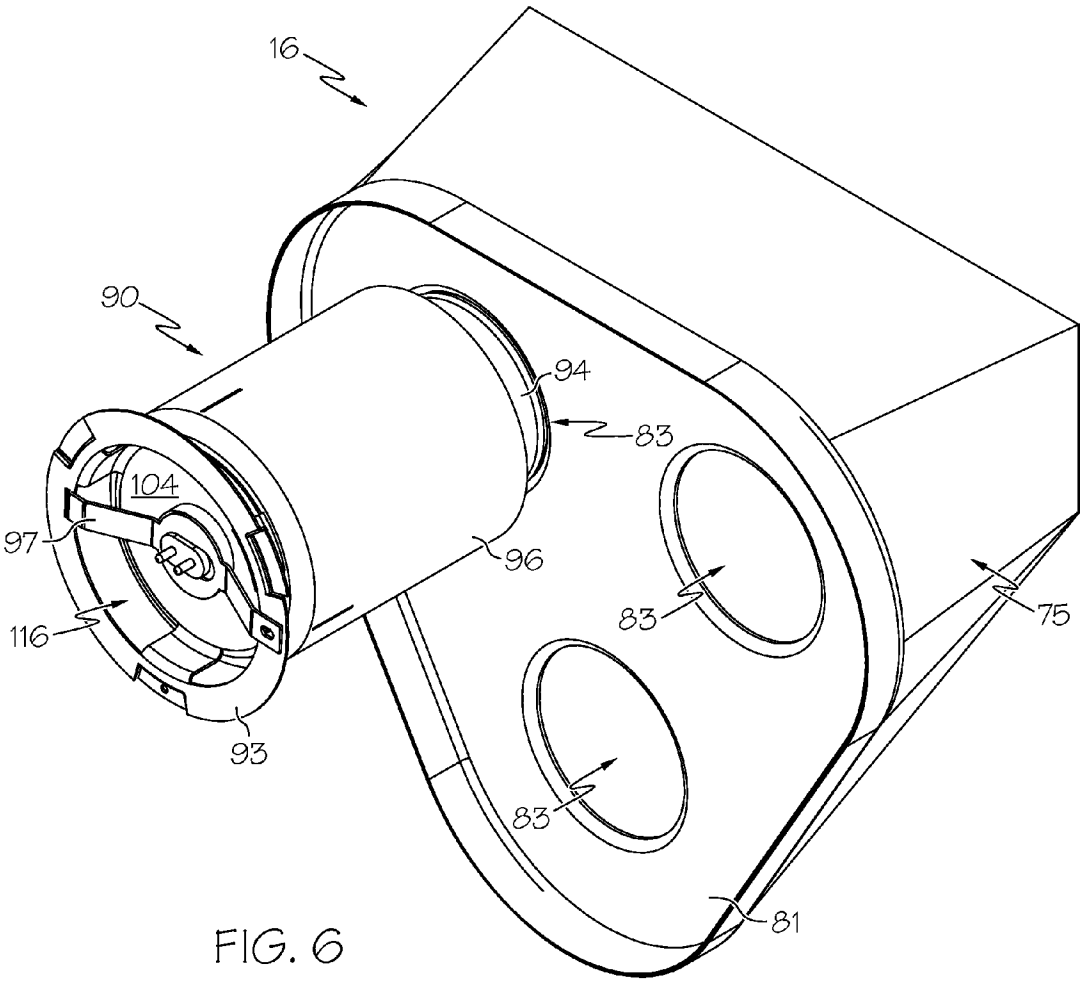
FIG. 6 is a perspective view of the heat exchanger of FIG. 4 coupled to an example heater core.

The dividing wall 81 in the heater core 16 can include at least one opening extending therethrough, such as a plurality of holes 83 extending therethrough. Each of the holes 83 can cooperate with, such as receive, a portion of a heat exchanger 90 so as to thereby enable fluid communication between the first and second portions 73, 75, via the heat exchanger(s) 90. In one example, as shown in FIG. 6, the heat exchanger 90 can be coupled to the dividing wall 81 about the hole 83, such that air moving through the heater core 16 is forced to proceed through the heat exchanger 90 prior to being discharged through the air outlet 32. For example, a portion, such as an end, of the inner cylinder 94 can be coupled to the dividing wall 81 about the hole 83 and can extend at least partially through the dividing wall 81 via the hole 83. The inner cylinder 94 can be removably or non-removably coupled to the dividing wall 81 in various manners, including fasteners, adhesives, welding, etc. and/or in a close-fitting arrangement, such as a frictional or interference fit, etc.

In one example, as shown in FIG. 2, the dividing wall 81 can force air moving through the heater core 16 to proceed through the heat exchanger(s) 90. Heater core 16 forms a plenum from which air is forced through heat exchangers 90 passing over energy sources 78 in the inner cylinders 94 of heat exchangers 90. For example, cool air is first drawn into the first portion 73, is heated by passage through the heat exchangers 90, and is exhausted through the second portion 75 and out of the air outlet 32. The first portion 73 can be a common input plenum feeding input air into each of the heat exchangers 90, while the second portion 75 can be an independent common output plenum receiving output air from each of the heat exchangers 90. In one example, the heater core 16 can include three heat exchangers 90, each including at least one thermal energy source 78 (e.g., about 500 watts each) as previously described herein. As shown in FIG. 6, each of the holes 83 in the dividing wall 81 can correspond generally with each of the holes 82 of the rear panel 54 such that each heat exchanger 90 can be oriented generally horizontally in a direction extending between the front and rear faces 18, 20 of the housing. For example, a portion of the inner cylinder 94 can be received within a corresponding hole 83, and can be removably or non-removably coupled thereto. In addition or alternatively, the inner cylinder 94 can include retaining structure 91 (see FIG. 5), such as an annular ring or the like, that can be adapted to retain the inner cylinder 94 within the hole 83.

In addition or alternatively, an auxiliary thermal energy source, such as an infrared emitter (not shown), may be mounted adjacent front wall 18 of exterior case 12 and front mounting panel 52 below air outlet 32. The auxiliary energy source can boost the temperature of the air passing out of heater 10 through air outlet 32. In addition, radiation from the auxiliary energy source can be reflected by copper deflector shield 60 to provide a comforting warm glow seen through grille 34 over air outlet 32. It should be understood that deflector shield 60 may also be formed of pretreated copper or aluminum but the glow through grille 34 may be somewhat compromised. In one embodiment of heater 10, auxiliary energy source can be a 250 watt quartz heating tube or other wattage.

Thus, as shown in FIG. 2, the instant design can form an air pathway defining a path of air movement progressing through the heater 10. For example, the air pathway can include some or all of the following to progress from the air inlet 30, to the intake chamber 62 and through the holes 82 via air passage 116 (or other holes) into the first portion 73 of the heater core 16, along the length of the outer cylinder 96 of the heat exchanger 90, through the intermediate chamber 100, through the inner cylinder 94, along the length of the thermal energy source 78, into the second portion 75 of the heater core 16, and out the air outlet 32.

In one example operation, thermostatic control 50 switches on energy sources 78 (and auxiliary heater, if present) whenever the temperature within the environment monitored by the thermostat drops below a predetermined minimum. Power is also supplied to fan 66 causing the fan to be activated. When temperature switch 67 is provided, activation of fan 66 may be delayed until the temperature in heater core 16 has risen to a selected temperature. This is done so that the air coming from heater 10 is warm on startup.

Upon being energized, energy sources 78 emit heat rays which are absorbed and reemitted by heat exchangers 90. Activation of fan 66 causes air to be circulated through heater 10. The circulating air is initially forced into intake chamber 62 through air inlet 30. As shown in FIG. 2, the air provided by fan 66 passes through the holes 82 of the rear panel 54, around the heat exchangers 90, and into the first portion 73 of the heater core 16. Though not shown, it is to be understood that the fan 66 can be mounted directly over the aperture(s) 82, such that the output of the fan 66 can flow directly into the aperture(s) 82. The dividing wall 81 inhibits, such as prevents, the air from entering second portion 75 and forces the air to enter each heat exchanger 90 through the gap 99 between the inner and outer cylinders 94, 96 such that the air is directed to take a serpentine, circuitous "S"-shaped path (when viewed in cross-section) though the intermediate chamber 100 defined between the outer cylinder 96 and the inner cylinder 94.

As the air passes through intermediate chambers 100, the air is heated by radiant energy from energy sources 78 and also by energy reemitted by portions of the heat exchangers 90 (e.g., cylinders 94, 96) before it enters the inner-most portion of the heat exchanger to flow directly past the energy source 78. The heated air then exits the heat exchanger 90 and flows directly into the second portion 75 of the heater core 16, and is then directed out of the outlet 32. The inner and outer cylinders 94, 96 of said heat exchanger 90 can each be oriented along a longitudinal axis substantially aligned along a direction from the air inlet 30 to the air outlet 32. For example, the longitudinal axis can extend in a horizontal direction aligned perpendicular and between the rear wall 20 having the air inlet 30 and the front wall 18 having the air outlet 32. The longitudinal axis can extend along the direction of arrow F.

Despite the serpentine pathway, the airflow pathway through the heater 10 is predominantly generally parallel to an axis perpendicular to and extending between the walls where inlet 30 and outlet 32 are located, such that a pressure drop is reduced, such as minimized, between the inlet 30 and outlet 32, which can thereby further increase the efficiency of the heater 10. For example, conventional heaters may utilize three or more directional changes of the airflow, each of which causes an associated pressure drop. In the instant application, the number of directional changes of the airflow is reduced to two in the serpentine path through the heat exchanger 90. Indeed, the flow direction of the air pathway (i.e., along the direction of arrow F) can include the serpentine pathway progressing through the heat exchanger 90. In one example, the air pathway can progress through the heater 10 substantially parallel to the longitudinal axis (i.e., in the direction of arrow F) and the heat exchanger(s) 90. In addition or alternatively, the thermal energy source 78 can be mounted within the heater core 16 along an axis generally parallel to said longitudinal axis (i.e., also along the direction of arrow F).

For example, orienting the heat exchangers 90 to be generally parallel to the direction F between the inlet 30 and outlet 32 can reduce the number of U-turns performed by the heated air to only two turns (i.e., via the serpentine "S"-shaped pathway). As a result, the heater 10 described above can be relatively more efficient than a conventional heater. Moreover, the heater 10 can further increase the overall efficiency by putting more heat into the air, keeping the exterior case 12 and cabinet relatively cooler. In addition or alternatively, a portion of the airflow from the fan 66 can proceed through the opening(s) 106 and directly into the air jacket 57 to further keep the exterior case 12 and cabinet relatively cooler. In addition or alternatively, the heater 10 described above can further increase the overall efficiency by positioning the energy sources 78 very close to the outlet 32, such that air heated by the energy sources 78 flows directly through the second portion 75 and out of the outlet 32, with little if any intermediate structure therebetween.

A single heater 10 as described can effectively heat up to 800 square feet, or even more, and is capable of safely increasing the temperature of the air drawn through the unit by approximately 120 degrees F. It is believed the thermal efficiency of heater 10 is affected by pretreatment of copper heat exchangers 90. In the embodiments described above, it is believed the heater 10 is more thermally efficient than a space heater wherein the copper cylinders have not been pretreated. It is further believed that this improvement results more heat from the same amount of power used. Other efficiencies may result from stripping residual heat from heater core 16 on shut down with high temperature limit switch and from the pathway of the air through heat exchangers 90 which can increase the dwell time of the air in heater core 16. It will be apparent that other design features discussed above also contribute to the space heater's thermal efficiency.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A heater, comprising:

an exterior case comprising an air inlet and an air outlet;

a heater core within the exterior case and being in communication with the air inlet and the air outlet;

a fan communicating with the air inlet and the air outlet for moving air through the heater core;

said heater core comprising a source of thermal energy and a heat exchanger, the heat exchanger comprising an inner duct and an outer duct, the inner duct being disposed adjacent and surrounding the source of thermal energy and the outer duct surrounding the inner duct to define an intermediate chamber between the inner and outer ducts;

said inner and outer ducts of said heat exchanger each oriented along a longitudinal axis extending between walls of said exterior case wherein said air inlet and air outlet are disposed, and wherein the heat exchanger is removably coupled to the heater to permit removal of the heat exchanger as a modular unit that comprises all of the outer duct, inner duct, intermediate chamber and the source of thermal energy.

2. The heater of claim 1, wherein the inner duct is arranged generally concentric with the outer duct.

3. The heater of claim 1, wherein the source of thermal energy is an infrared emitter.

4. The heater of claim 1, further comprising a dividing wall separating the heater core into a first portion adjacent the air inlet and a second portion adjacent the air outlet, the dividing wall inhibiting fluid communication between the air inlet and air outlet.

5. The heater of claim 4, wherein the dividing wall has an opening extending therethrough and the heat exchanger is in fluid communication with the opening, such that air moving through the heater core from the first portion to the second portion is forced to proceed through the heat exchanger.

6. The heater of claim 1, further comprising an air jacket extending at least partially between the exterior case and the heater core, the air jacket being in fluid communication with the air inlet and air outlet to provide a cooling airflow through the air jacket.

7. The heater of claim 1, wherein the heat exchanger comprises a bracket adapted to positively couple the source of thermal energy to the heat exchanger, the bracket being at least partially removable from the heat exchanger to permit replacement of the source of thermal energy without removal of the heat exchanger from the heater.

8. The heater of claim 1, wherein the heat exchanger further comprises a spacing coupler extending between and coupling the inner duct to the outer duct.

9. The heater of claim 1, wherein at least one of said inner and outer ducts comprises a cylinder.

10. The heater of claim 9, wherein said at least one of said inner and outer ducts that comprises a cylinder further comprises a circular cross-section.

11. The heater of claim 9, wherein said inner duct comprises a cylinder and said outer duct comprises a cylinder.

12. The heater of claim 1, further comprising an air pathway extending through the heater along said longitudinal axis, and wherein the source of thermal energy is mounted within the heater core along an axis generally parallel to said longitudinal axis.

13. The heater of claim 1, wherein the heat exchanger comprises a mounting plate coupled to the outer duct, the mounting plate being removably coupled to the heater to permit removal of the source of thermal energy.

14. The heater of claim 13, wherein the heat exchanger is coupled to the heater via a twist-lock arrangement.

15. A heater, comprising:

an exterior case comprising an air inlet and an air outlet;

a heater core within the exterior case and being in communication with the air inlet and the air outlet;

a fan communicating with the air inlet and the air outlet for moving air through the heater core;

said heater core comprising a source of thermal energy and a heat exchanger, the heat exchanger being disposed within the heater core and extending along a longitudinal axis extending between walls of said exterior case wherein said air inlet and air outlet are disposed, the heat exchanger comprising an inner duct surrounding the source of thermal energy and an outer duct surrounding the inner duct; and an air pathway defining a path of air movement progressing from the air inlet, through the heat exchanger, and out the air outlet, wherein the heat exchanger comprises a mounting plate coupled to the outer duct, the mounting plate being removably coupled to the heater to permit removal of the heat exchanger as a modular unit that comprises all of the outer duct, inner duct, and the source of thermal energy, and wherein the mounting plate is coupled to the heater via a twist-lock arrangement.

16. The heater of claim 15, wherein the air pathway includes a serpentine pathway progressing through the heat exchanger.

17. The heater of claim 15, further comprising a dividing wall separating the heater core into a first portion adjacent the air inlet and a second portion adjacent the air outlet, the dividing wall inhibiting fluid communication between the air inlet and air outlet, the dividing wall further comprising an opening extending therethrough and the heat exchanger being in fluid communication with the opening, such that air moving through the heater core is forced to proceed through the heat exchanger.

18. The heater of claim 15, further comprising an air jacket extending at least partially between the exterior case and the heater core, the air jacket being in fluid communication with the air inlet and air outlet to provide a cooling airflow through the air jacket.

19. The heater of claim 15, wherein at least one of said inner and outer ducts comprises a cylinder.

20. The heater of claim 15, wherein the air pathway extends along the outer duct of the heat exchanger, then through an intermediate chamber between the inner and outer ducts, and then through the inner duct and along the length of the source of infrared energy, prior to being discharged out the air outlet.

21. A heater, comprising:

an exterior case comprising an air inlet and an air outlet;

a heater core within the exterior case and being in communication with the air inlet and the air outlet;

a dividing wall separating the heater core into a first portion adjacent the air inlet and a second portion adjacent the air outlet, the dividing wall inhibiting fluid communication between the air inlet and air outlet, the dividing wall further comprising an opening extending therethrough;

a fan communicating with the air inlet and the air outlet for moving air through the heater core;

said heater core comprising a source of thermal energy and a heat exchanger, the heat exchanger being disposed within the heater core and comprising an inner duct surrounding said source of thermal energy and an outer duct surrounding the inner duct, wherein the heat exchanger is in fluid communication with the opening, such that air moving through the heater core from the first portion to the second portion is forced to proceed through the heat exchanger prior to being discharged through said opening and thereafter through the air outlet, wherein the heat exchanger is removably coupled to the heater to permit removal of the heat exchanger as a modular unit that comprises all of the outer duct, inner duct, and the source of thermal energy.

22. The heater of claim 21, wherein the inner duct is coupled to the dividing wall about the opening.

23. The heater of claim 21, wherein the heat exchanger is disposed within the heater core and extends along a longitudinal axis extending between walls of said exterior case wherein said air inlet and air outlet are disposed.

24. The heater of claim 21, further comprising an air jacket extending at least partially between the exterior case and the heater core, the air jacket being in fluid communication with the air inlet and air outlet to provide a cooling airflow through the air jacket.

25. The heater of claim 21, wherein at least one of said inner and outer ducts comprises a cylinder.

26. The heater of claim 21, wherein the heat exchanger further comprises a bracket adapted to positively couple the source of thermal energy to the heat exchanger, the bracket being at least partially removable from the heat exchanger to permit replacement of the source of thermal energy without removal of the heat exchanger from the heater.

* * * * *